US011455871B2

(12) United States Patent
Bender et al.

(10) Patent No.: US 11,455,871 B2
(45) Date of Patent: Sep. 27, 2022

(54) WIRELESS MAILBOX NOTIFICATION SYSTEM

(71) Applicants: Ricky Bender, Topeka, KS (US); Julie Bender, Topeka, KS (US)

(72) Inventors: Ricky Bender, Topeka, KS (US); Julie Bender, Topeka, KS (US)

( * ) Notice: Subject to any disclaimer, the term of this patent is extended or adjusted under 35 U.S.C. 154(b) by 0 days.

(21) Appl. No.: 17/589,236

(22) Filed: Jan. 31, 2022

(65) Prior Publication Data

US 2022/0254235 A1 Aug. 11, 2022

Related U.S. Application Data

(60) Provisional application No. 63/146,540, filed on Feb. 5, 2021.

(51) Int. Cl.

| | |
|---|---|
| ***G08B 13/14*** | (2006.01) |
| ***G08B 1/08*** | (2006.01) |
| ***G08B 13/189*** | (2006.01) |
| ***G08B 5/22*** | (2006.01) |

(52) U.S. Cl.
CPC ..... *G08B 13/1895* (2013.01); *G08B 5/22* (2013.01)

(58) Field of Classification Search
CPC ..... G08B 13/1895; G08B 5/22
See application file for complete search history.

(56) References Cited

U.S. PATENT DOCUMENTS

| | | | | |
|---|---|---|---|---|
| 4,755,915 | A * | 7/1988 | Rogers | F21V 33/0024 D99/29 |
| 5,975,713 | A * | 11/1999 | Brothers | F21S 9/03 362/802 |
| 6,102,548 | A * | 8/2000 | Mantle | A47G 29/1209 362/802 |
| 6,402,338 | B1 * | 6/2002 | Mitzel | F21S 9/037 362/183 |
| 6,462,659 | B1 * | 10/2002 | Schuette | A47G 29/1214 340/569 |
| 6,831,558 | B1 * | 12/2004 | Andrew | G08B 25/10 340/568.1 |
| 7,025,249 | B1 | 4/2006 | Ledbetter | |
| 7,187,285 | B2 * | 3/2007 | Staples | A47G 29/1225 340/569 |
| 7,786,862 | B1 * | 8/2010 | Campbell | A47G 29/1214 340/569 |
| 7,843,340 | B2 * | 11/2010 | Davis | A47G 29/1214 455/412.2 |

(Continued)

*Primary Examiner* — Hai Phan
*Assistant Examiner* — Son M Tang
(74) *Attorney, Agent, or Firm* — Boudwin Intellectual Property; Daniel Boudwin

(57) ABSTRACT

A wireless mailbox notification system is provided. The system includes a housing structure having a plurality of sensors and a processor therein. The plurality of sensors includes a light sensor and a motion sensor. A wireless transceiver is in operable communication with the plurality of sensors and the processor. The wireless transceiver wirelessly transmits an alert generated by the processor to an application installed on a remote device upon actuation of at least one sensor of the plurality of sensors. In some embodiments, an electronic message is automatically generated and transmitted to a desired recipient, such as via email or text message. A fastener is disposed on the housing, wherein the fastener removably secures the housing to a support surface.

20 Claims, 3 Drawing Sheets

(56) References Cited

U.S. PATENT DOCUMENTS

| | | | | |
|---|---|---|---|---|
| 9,336,667 | B2 | 5/2016 | Hammoud | |
| 9,609,972 | B1 * | 4/2017 | DuBois | A47G 29/1225 |
| 10,028,111 | B2 * | 7/2018 | Ansari | A47G 29/121 |
| 10,107,480 | B1 * | 10/2018 | Ladewig | F21S 8/036 |
| 10,827,867 | B1 * | 11/2020 | Vangi | H04W 4/12 |
| 10,976,647 | B2 * | 4/2021 | Liao | G03B 5/02 |
| 10,986,950 | B2 * | 4/2021 | Van Valkenburg, III | H04N 7/181 |
| 2004/0212502 | A1 * | 10/2004 | Dalgaard | A47G 29/1214 340/569 |
| 2005/0122220 | A1 | 6/2005 | Staples | |
| 2015/0035437 | A1 * | 2/2015 | Panopoulos | F21S 8/085 315/291 |
| 2016/0003461 | A1 * | 1/2016 | Chen | F21V 33/00 362/249.02 |
| 2016/0189527 | A1 * | 6/2016 | Peterson | G08B 31/00 340/541 |
| 2017/0295979 | A1 * | 10/2017 | Appell | A47G 29/1214 |
| 2018/0374332 | A1 * | 12/2018 | Waclawik | G08B 21/18 |
| 2019/0167024 | A1 * | 6/2019 | Bradish | A47G 29/121 |
| 2021/0182569 | A1 * | 6/2021 | Lindsey | G06V 20/52 |
| 2022/0020249 | A1 * | 1/2022 | Castellano | G06N 20/00 |

* cited by examiner

WIRELESS MAILBOX NOTIFICATION SYSTEM

CROSS REFERENCE TO RELATED APPLICATIONS

This application claims the benefit of U.S. Provisional Application No. 63/146,540 filed on Feb. 5, 2021. The above identified patent application is herein incorporated by reference in its entirety to provide continuity of disclosure.

BACKGROUND OF THE INVENTION

The present invention relates to mailbox notification systems. More particularly, the present invention pertains to a wireless mailbox notification system that automatically generates and transmits an alert to a user via email, text message, or an alert received via an associated application installed on a remote device.

Many individuals rely on the postal service for the delivery of important documents, packages, or the like. For example, some important documents may include bills, tax forms, or credit cards which can be hard to replace if they get misplaced or lost. Additionally, such important documents are often time sensitive and require swift action from the recipient. However, an individual may be unaware that any documents have been placed within their mailbox. In such cases, the mail can be damaged by weather or even stolen if there is no lock on the mailbox. Furthermore, when an individual anticipates the arrival of an important document, they may make frequent, unnecessary trips to the mailbox. For many individuals, such frequent trips may be difficult due to distance, weather, or the like. Additionally, frequent trips may increase the risk of injury due to falls, traffic accidents, or other hazards. However, if the individual were to know when new mail is placed within their mailbox, they will be able to reduce the number of trips to the mailbox to retrieve the mail and the length of time the mail is left in the mailbox to reduce the risk of damage or theft. In order to address these concerns, the present invention provides users with a sensor system capable of detecting and alerting a user of delivered mail.

In light of the devices disclosed in the known art, it is submitted that the present invention substantially diverges in design elements from the known art and consequently it is clear that there is a need in the art for an improvement to existing mailbox notification systems. In this regard, the instant invention substantially fulfills these needs.

SUMMARY OF THE INVENTION

In view of the foregoing disadvantages inherent in the known types of mailbox notification systems now present in the known art, the present invention provides a wireless mailbox notification system wherein the same can be utilized for providing convenience for the user when alerting the user of the presence of mail within the mailbox via email, text message, or a mobile device application alert.

The present system comprises a housing structure having a plurality of sensors and a processor therein, wherein the plurality of sensors includes a light sensor and a motion sensor. A wireless transceiver is in operable communication with the plurality of sensors and the processor, wherein the wireless transceiver wirelessly transmits an alert generated by the processor to an application installed on a remote device upon actuation of at least one sensor of the plurality of sensors. In some embodiments, the processor automatically generates an electronic message upon actuation of one or more of the plurality of sensors, wherein the wireless transceiver wirelessly transmits an electronic message to a desired recipient, such as an email message or a text message. A fastener disposed on the housing, wherein the fastener is configured to removably secure the housing to a support surface.

In some embodiments, the housing structure comprises an upper housing affixed to a lower housing via a support arm extending therebetween, wherein the light sensor is disposed centrally on a front face of the upper housing, and the motion sensor is disposed on a front side of the lower housing. In another embodiment, the fastener is disposed on a planar rear surface of the upper housing. In other embodiments, the front face of the upper housing is recessed defining a perimeter lip. In yet another embodiment, a front side of the lower housing is arcuate. In some embodiments, the lower housing is affixed to a first side of the support arm at a lower end thereof, and the upper housing is affixed to an upper end of the support arm, such that a rear surface of the upper housing rests along a plane parallel to the first side of the support arm. In another embodiment, the fastener comprises an adhesive pad. In other embodiments, a protective backing is removably securable over the fastener. In yet another embodiment, the application records the date and time of receipt of the alert. In some embodiments, the electronic message includes the date and time of actuation of the plurality of sensors.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1B:
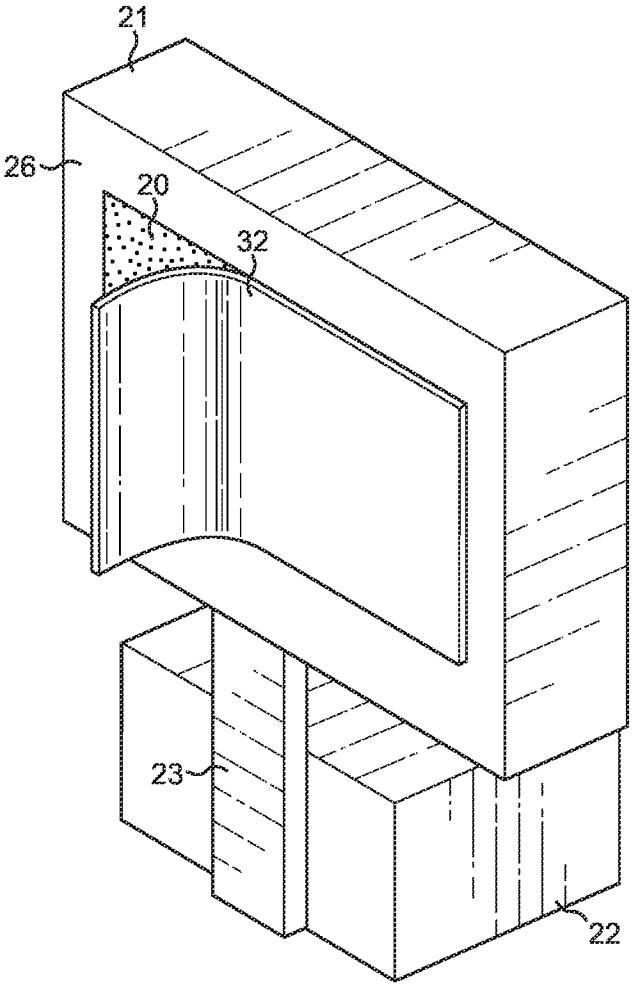
FIG. 1B shows a rear perspective view of an embodiment of the wireless mailbox notification system.

Reference is made herein to the attached drawings. Like reference numerals are used throughout the drawings to depict like or similar elements of the wireless mailbox notification system. The figures are intended for representative purposes only and should not be considered to be limiting in any respect.

According to some embodiments, the operations, techniques, and/or components described herein can be implemented as (i) a special-purpose computing device having specialized hardware and a logic hardwired into the computing device to persistently perform the disclosed operations and/or techniques or (ii) a logic that is implementable on an electronic device having a general purpose hardware processor to execute the logic and a computer-readable medium, e.g. a memory, wherein implementation of the logic by the processor on the electronic device provides the electronic device with the function of a special-purpose computing device.

In the interests of economy, the present disclosure refers to "a computer-readable medium," "a processor," and so on. However, this should not be read as limiting in any way as the present disclosure contemplates embodiments of the present invention utilizing "one or more computer-readable media," "one or more processors," and so on. Unless specifically limited to a single unit, "a" is intended to be equivalent to "one or more" throughout the present disclosure.

As referred to herein, the term "electronic device" refers to any computing device that includes at least a display screen and an input mechanism. The computing devices can be hard-wired to perform the operations, techniques, and/or components described herein, or can include digital electronic devices such as one or more application-specific integrated circuits (ASICs) or field programmable gate arrays (FPGAs) that are persistently programmed to perform the operations, techniques and/or components described herein, or can include one or more general purpose hardware processors programmed to perform such features of the present disclosure pursuant to program instructions in firmware, memory, other storage, or a combination. Such computing devices can also combine custom hard-wired logic, ASICs, or FPGAs with custom programming to accomplish the technique and other features of the present disclosure. The computing devices can be desktop computer systems, laptops, cell phones, tablets, networking devices, or any other device that incorporates hard-wired and/or program logic to implement the techniques and other features of the present disclosure.

Figure 1A:
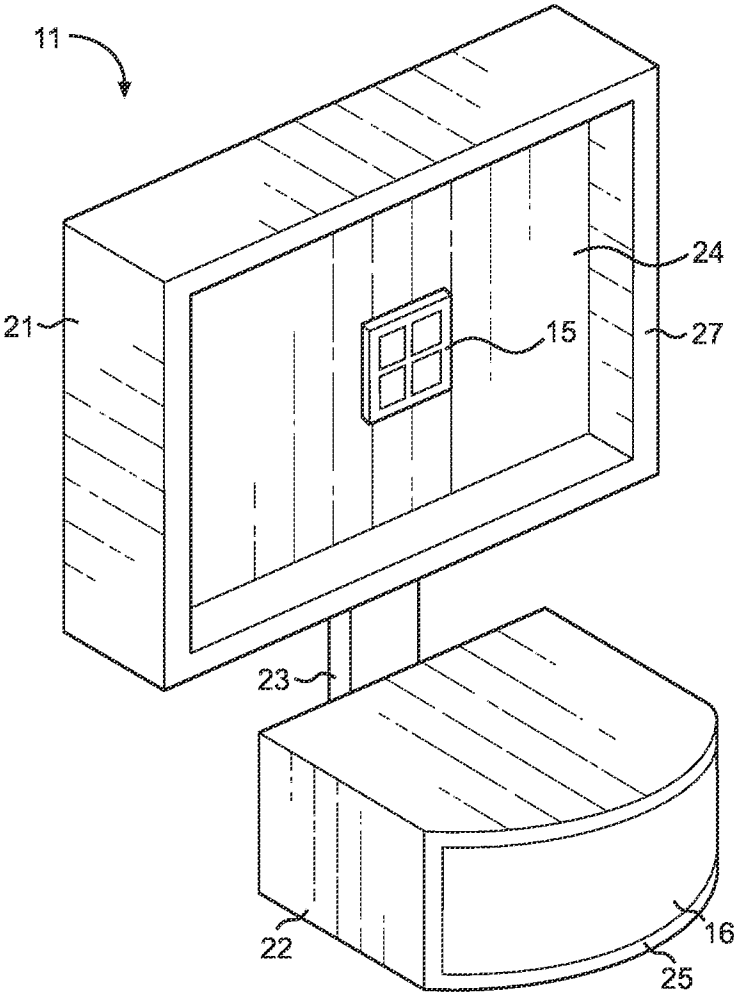
FIG. 1A shows a front perspective view of an embodiment of the wireless mailbox notification system.

Referring now to FIGS. 1A and 1B, there is shown a front perspective view of an embodiment of the wireless mailbox notification system and a rear perspective view of an embodiment of the wireless mailbox notification system, respectively. The wireless mailbox notification system 11 comprises a housing structure removably securable within a mailbox housing, wherein the wireless mailbox notification system 11 is configured to remotely notify a user of the delivery of mail within the mailbox housing. Particularly, the wireless mailbox notification system 11 detects when the mailbox door opens and closes, as well as when mail is inserted within the interior volume of mailbox via a plurality of sensors disposed within the housing structure, as further described elsewhere herein. In the illustrated embodiment, the housing structure comprises an upper housing 21 affixed to a lower housing 22 via a support arm 23 extending therebetween, wherein each of the upper and lower housings 21, 22 include a sensor of the plurality of sensors therein. In this manner, the upper and lower housings 21, 22 can be dimensioned and positioned relative to each other to optimize efficiency of each sensor's detection capabilities.

Figure 2:
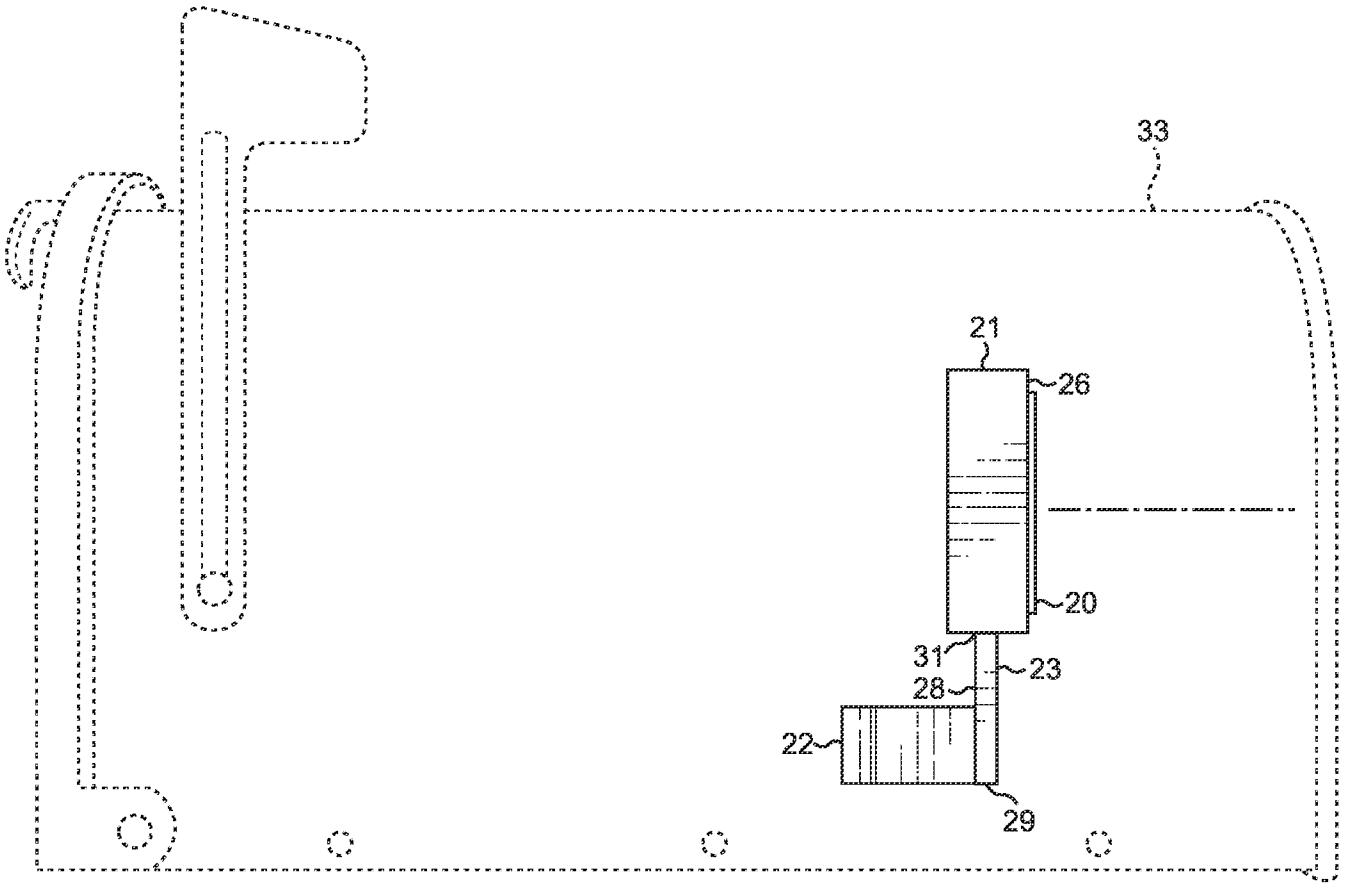
FIG. 2 shows a side view of an embodiment of the wireless mailbox notification system affixed to an interior mailbox wall.

In the shown embodiment, the upper housing 21 comprises a light sensor 15 disposed therein, wherein the light sensor 15 is configured to detect variations of light levels within the mailbox housing and actuate upon the detected light level exceeds a predetermined threshold. In this manner, the light sensor 15 can be calibrated to determine when a door of the mailbox housing is opened, to alert the user of a potential mail delivery. In the illustrated embodiment, the light sensor 15 is centrally disposed within a front face 24 of the upper housing 21 to provide an even distribution of light across the light sensor 15 in order to further optimize the function of the light sensor 15. In the illustrated embodiment, the front face 24 is recessed within the upper housing 21 defining a perimeter lip 27 therearound. The perimeter lip 27 serves to limit light impacting the light sensor 15 to light originating from a position forward of the front face 24, such as when the door of the mailbox housing in which the wireless mailbox notification system 11 is installed is opened. In this manner, the perimeter lip 27 prevents light pollution from areas surrounding the upper housing 21 from actuating the light sensor 15, such as light leaking through seams in the mailbox housing, or from adjacent mailbox housings in a multiple mailbox unit, such as those found in apartment complexes. In the shown embodiment, the upper housing 21 further comprises a fastener 20 disposed across a rear surface 26 of the upper housing 21. The fastener 20 is configured to removably secure the upper housing 21 to a support surface, such as a rear wall of a mailbox housing (as shown in FIG. 2, 33). In the shown embodiment, the fastener 20 comprises an adhesive pad having a backing material 32 removably secured thereover, such that the backing material 32 preserves the adhesive until the user desires to affix the upper housing 21 to a desired surface. In alternate embodiments, the fastener 20 is contemplated to includes alternate fasteners, such as, but not limited to complementary hook and loop fasteners, mechanical fasteners, and the like.

In the shown embodiment, the lower housing 22 comprises a motion sensor 16 therein, wherein the motion sensor 16 is configured to detect activity in the vicinity of the housing structure, such as mail being placed within the interior volume of the mailbox housing. In some embodiments, the motion sensor 16 is calibrated to detect an immediate vicinity of the lower housing 22, such that opening of the door of the mailbox housing does not trigger the motion sensor 16, however mail being placed within the interior volume of the mailbox housing actuates the motion sensor 16. In this manner, the wireless mailbox notification system 11 alerts a user to the delivery of mail via a combination of sensor data, thereby reducing the risk of a false positive alert being delivered to the user. In the shown embodiment, the lower housing 22 is disposed on a first side of the support arm 23, such that the motion sensor 16 is disposed forward of the upper housing 21. In this manner, no portion of the upper housing 21 occludes the motion sensor 16 ensuring a maximized field of view. Furthermore, in the illustrated embodiment, a front side 25 of the lower housing 22 comprises an arcuate shape such that the functional area of the motion sensor 16 is curved along the arcuate front side 25. In this manner, the field of view provided to the motion sensor 16 is increased to ensure a majority of the interior volume of the mailbox housing is within the detection range of the motion sensor 16.

Referring now to FIG. 2, there is shown a side view of an embodiment of the wireless mailbox notification system affixed to an interior mailbox wall. In the illustrated embodiment, the upper housing 21 is affixed to an upper end 31 of the support arm 23 and the lower housing 22 is affixed to a lower end 29 of the support arm 23. The lower housing 22 is further affixed to a first side 28 of the support arm 23 such that the lower housing 22 is disposed forward of the upper housing 21, ensuring proper operation of the motion sensor within the lower housing 22. Furthermore, the upper housing 21 is disposed on the upper end 31 such that the rear surface 26 of the upper housing 21 is disposed along a distinct plane parallel to a second side of the support arm 23 opposite the first side 28, such that the lower housing 22 and the support arm 23 are held away from the rear surface 26. In this manner, the support arm 23 and the lower housing 22 do not interfere with securement of the upper housing 21 to the rear wall of the mailbox housing 33 via the fastener 20. In one exemplary use, the user can peel the protective backing material from the fastener 20 and secure the upper housing 21 on the rear wall of the mailbox housing 33. By securing the fastener 20 to the rear wall, the user ensures that the plurality of sensors are aligned and directed towards the front opening of the mailbox housing 33 to detect when the mailbox housing door is opened, and mail is placed within the interior volume.

Figure 3:
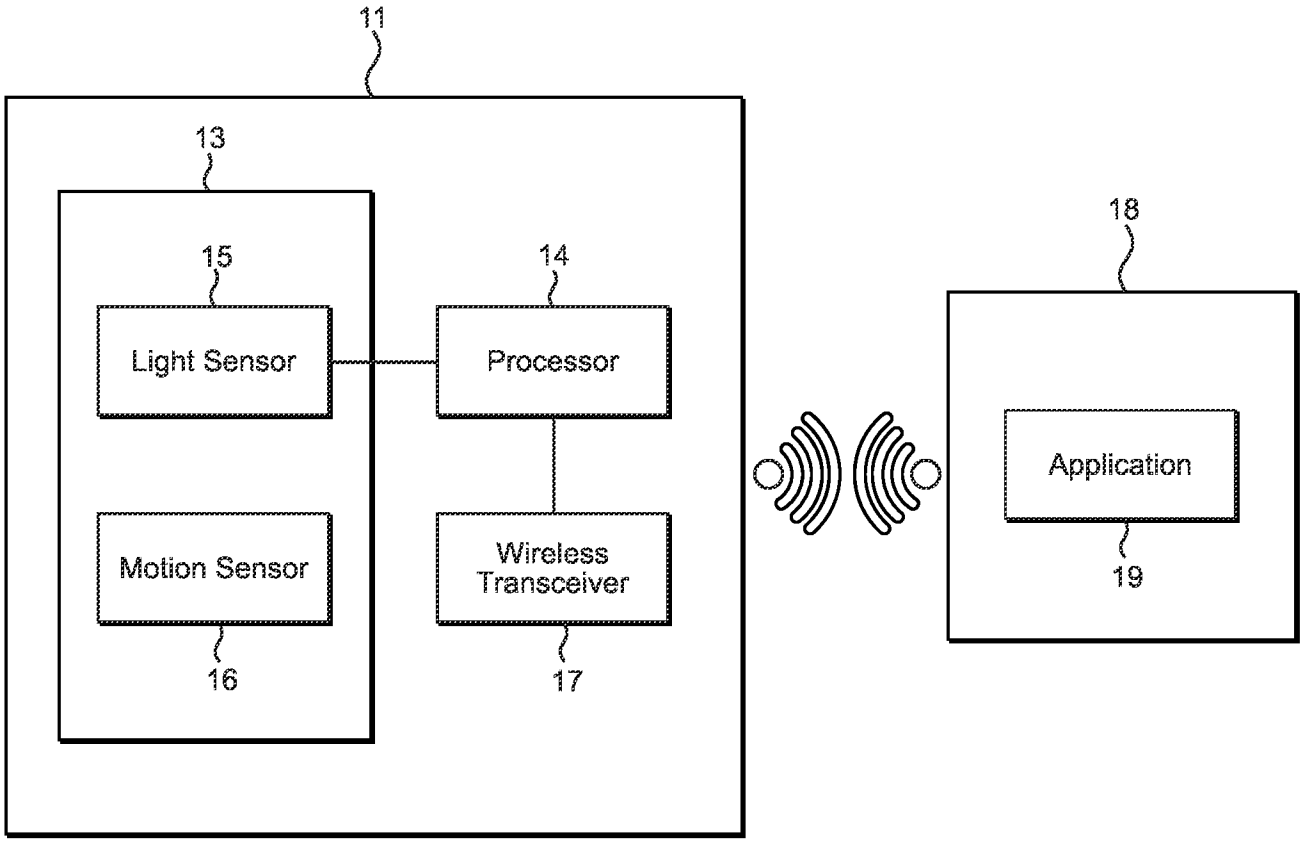
FIG. 3 shows a schematic view of an embodiment of the wireless mailbox notification system.

Referring now to FIG. 3, there is shown a schematic view of an embodiment of the wireless mailbox notification system. In the illustrated embodiment, the wireless mailbox notification system 11 is in wireless communication with a remote device 18, such as a smartphone, tablet, laptop, telecommunications network, or remote email server via a wireless transceiver 17 disposed within the housing structure. In this manner, upon actuation of the plurality of sensors 13, a processor 14 disposed within the housing structure generates a notification that is transmitted to the remote device 18 via the wireless transceiver 17. In some embodiments, the generated notification includes a time and date of actuation of the plurality of sensors 13, such that the user is notified of the precise timing of the delivery of mail or other potentially unauthorized access to the user's mailbox. In embodiments wherein the remote device 18 comprises a smartphone, tablet, laptop, or other computing device, an application 19 installed on the remote device 18 can adjust the thresholds upon which the processor 14 generates the notification, as well as providing a platform upon which the notification can be displayed. In some embodiments, the application 19 is further configured to generate an audible alert upon receipt of the generated notification from the wireless mailbox notification system 11. For example, the user may wish to alter the sensor conditions upon which the processor 14 generates the notification, such that independent or simultaneous actuation of the plurality of sensors 13 is required to generate a notification. Simultaneous actuation may prevent false positives wherein random vibrations, such as moving vehicles in proximity to the mailbox, trigger the motion sensor in isolation, or the mailbox door is opened without mail being deposited or removed from the interior volume, causing an alert to be generated. Alternatively, independent actuation triggering the generation of a notification may be preferable when a user wishes to be apprised of any and all potential interactions with their mailbox to ensure delivery or theft of mail is not missed. Additionally, a user may utilize the application 19 to adjust the conditions in which the motion sensor 16 and the light sensor 15 are actuated, such as adjusting the predetermined thresholds for movement or light, respectively. In some embodiments, the light sensor 15 may be calibrated to actuate only upon detection of light above the predetermined threshold followed by a subsequent decrease of light below the predetermined threshold, such as when the door of the mailbox is opened and closed. In this manner, the user is only notified upon completion of mail delivery rather than the initiation of mail delivery. Alternatively, when the remote device 18 comprises a telecommunications network or a remote email server, the generated notification may be transmitted to a designated telephone number or email address, respectively. In this manner, the user can be alerted through a traditionally utilized messaging means, such as text messaging or email messages. In such embodiments, the text of the particular message may be configured to include the time, date, and reason for generation of the notification to provide sufficient information for the user to determine whether mail was delivered. For example, if the user receives multiple notifications between checking the mailbox, it may indicate that another individual accessed the mailbox before the user, potentially indicating mail theft. In this manner, the user can readily track the status of mail delivery without making any trips to the mailbox, while also providing additional information in the case of mail theft.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly, and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A wireless mailbox notification system, comprising:

a housing structure having a plurality of sensors and a processor therein;

wherein the housing structure comprises an upper housing affixed to a lower housing via a support arm extending therebetween;

wherein the plurality of sensors includes a light sensor and a motion sensor; wherein the light sensor is disposed centrally on a front face of the upper housing, and the motion sensor is disposed on a front side of the lower housing;

wherein the front face and the front side are offset and oriented in a same direction; a wireless transceiver in operable communication with the plurality of sensors and the processor;

wherein the wireless transceiver wirelessly transmits an alert generated by the processor to an application installed on a remote device upon actuation of at least one sensor of the plurality of sensors via a threshold light level and a threshold motion level being exceeded, respectively;

wherein the remote device comprises a smartphone, tablet, laptop computer, or desktop computer;

a fastener disposed on the housing, wherein the fastener is configured to removably secure the housing to a support surface of a rear wall within a mailbox.

2. The wireless mailbox notification system of claim 1, wherein the fastener is disposed on a planar rear surface of the upper housing.

3. The wireless mailbox notification system of claim 1, wherein the front face of the upper housing is recessed defining a perimeter lip, the perimeter lip extending perpendicularly from the front face.

4. The wireless mailbox notification system of claim 1, wherein a front side of the lower housing is arcuate.

5. The wireless mailbox notification system of claim 1, wherein the lower housing is statically affixed to a first side of the support arm at a lower end thereof, and the upper housing is statically affixed to an upper end of the support arm, such that a rear surface of the upper housing rests along a plane parallel to a planar rear face of the lower housing.

6. The wireless mailbox notification system of claim 1, wherein the fastener comprises an adhesive pad.

7. The wireless mailbox notification system of claim 6, further comprising a protecting backing removably securable over the fastener.

8. The wireless mailbox notification system of claim 1, wherein the processor generates the alert only upon simultaneous actuation of each of the plurality of sensors.

9. The wireless mailbox notification system of claim 1, wherein the application records the date and time of receipt of the alert.

10. The wireless mailbox notification system of claim 1, wherein the light sensor is actuated upon detection of light exceeding the threshold light level followed by a subsequent detection of light falling below the threshold light level.

11. The wireless mailbox notification system of claim 1, wherein the threshold light level and the threshold motion level are adjustable via the application installed on the remote device.

12. A wireless mailbox notification system, comprising:

a housing structure having a plurality of sensors and a processor therein;

wherein the housing structure comprises an upper housing affixed to a lower housing via a support arm extending there between;

wherein the plurality of sensors includes a light sensor and a motion sensor;

wherein the light sensor is disposed centrally on a front face of the upper housing, and the motion sensor is disposed on a front side of the lower housing; wherein the front face and the front side are offset and oriented in a same direction;

a wireless transceiver in operable communication with the plurality of sensors and the processor;

wherein the processor automatically generates an electronic message upon actuation of one or more of the plurality of sensors via a threshold light level and a threshold motion level being exceeded, respectively;

wherein the wireless transceiver wirelessly transmits the electronic message to a desired recipient;

wherein a format of the electronic message is selected from a group consisting of: a text message delivered via a telecommunications network in wireless communication with the wireless transceiver, and an email message delivered via a remote email server in wireless communication with the wireless transceiver;

a fastener disposed on the housing, wherein the fastener is configured to removably secure the housing to a support surface of a rear wall within a mailbox.

13. The wireless mailbox notification system of claim 12, wherein the fastener is disposed on a planar rear surface of the upper housing.

14. The wireless mailbox notification system of claim 12, wherein the front face of the upper housing is recessed defining a perimeter lip, the perimeter lip extending perpendicularly from the front face.

15. The wireless mailbox notification system of claim 12, wherein a front side of the lower housing is arcuate.

16. The wireless mailbox notification system of claim 12, wherein the lower housing is statically affixed to a first side of the support arm at a lower end thereof, and the upper housing is statically affixed to an upper end of the support arm, such that a rear surface of the upper housing rests along a plane parallel to a planar rear face of the lower housing.

17. The wireless mailbox notification system of claim 12, wherein the fastener comprises an adhesive pad.

18. The wireless mailbox notification system of claim 17, further comprising a protecting backing removably securable over the fastener.

19. The wireless mailbox notification system of claim 12, wherein the processor generates the alert only upon simultaneous actuation of each of the plurality of sensors.

20. The wireless mailbox notification system of claim 12, wherein the electronic message includes the date and time of actuation of the plurality of sensors.

* * * * *